US006619388B2

(12) United States Patent
Dietz et al.

(10) Patent No.: US 6,619,388 B2
(45) Date of Patent: Sep. 16, 2003

(54) FAIL SAFE SURFACE CONTROLLED SUBSURFACE SAFETY VALVE FOR USE IN A WELL

(75) Inventors: Wesley P. Dietz, Carrollton, TX (US); Robert A. Rademaker, The Colony, TX (US); Ronald W. McGregor, Carrollton, TX (US); Bruce E. Scott, Plano, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/784,723

(22) Filed: Feb. 15, 2001

(65) Prior Publication Data

US 2002/0108747 A1 Aug. 15, 2002

(51) Int. Cl.[7] ..... E21B 23/00; E21B 34/08; E21B 43/00

(52) U.S. Cl. ..... 166/66.7; 166/53; 166/66; 166/386; 166/332.8; 166/334.2

(58) Field of Search ..... 166/363, 364, 166/367, 323, 381, 386, 53, 66, 66.4, 66.5, 66.6, 166, 319, 66.7, 332.8, 334.2

(56) References Cited

U.S. PATENT DOCUMENTS

| | | | | | |
|---|---|---|---|---|---|
| 4,077,473 | A | * | 3/1978 | Watkins | 166/323 |
| RE30,110 | E | * | 10/1979 | Huebsch et al. | 166/66.7 |
| 4,407,329 | A | * | 10/1983 | Huebsch et al. | 166/332.7 |
| 4,467,870 | A | | 8/1984 | Langham | 166/321 |
| 4,566,534 | A | * | 1/1986 | Going, III | 166/66.7 |
| 4,579,177 | A | * | 4/1986 | Going, III | 166/332.8 |
| 4,603,742 | A | * | 8/1986 | Wong et al. | 166/373 |
| 4,619,320 | A | * | 10/1986 | Adnyana et al. | 166/66.7 |
| 4,667,736 | A | * | 5/1987 | Rumbaugh et al. | 166/117.5 |
| 4,796,708 | A | * | 1/1989 | Lembcke | 166/66.7 |
| 5,070,944 | A | * | 12/1991 | Hopper | 166/66.7 |
| 5,195,721 | A | | 3/1993 | Akkerman | 251/129 |
| 5,293,943 | A | * | 3/1994 | Williamson, Jr. | 166/319 |
| 5,564,502 | A | * | 10/1996 | Crow et al. | 166/316 |
| 5,564,675 | A | * | 10/1996 | Hill et al. | 166/321 |
| 5,598,864 | A | * | 2/1997 | Johnston et al. | 166/317 |
| 5,620,048 | A | * | 4/1997 | Beauquin | 166/62 |
| 6,199,629 | B1 | * | 3/2001 | Shirk et al. | 166/302 |
| 6,237,693 | B1 | * | 5/2001 | Deaton | 166/151 |
| 6,253,843 | B1 | * | 7/2001 | Rawson et al. | 166/332.8 |
| 6,257,356 | B1 | * | 7/2001 | Wassell | 166/66.5 |
| 6,269,874 | B1 | * | 8/2001 | Rawson et al. | 166/332.6 |
| 6,352,118 | B1 | * | 3/2002 | Dickson et al. | 166/322 |

FOREIGN PATENT DOCUMENTS

| | | | | |
|---|---|---|---|---|
| GB | 2240376 A | * | 7/1991 | |
| WO | 0053890 | | 9/2000 | 34/6 |

OTHER PUBLICATIONS

Superior Performance, Tubing Retrievable Subsurface Safety Valve, Halliburton, Aug. 1998, pp. 1–4.

Non–Elastomer Tubing–Retrievable Safety Valves, Halliburton, pp. 4–6 and 4–7.

* cited by examiner

*Primary Examiner*—David Bagnell
*Assistant Examiner*—Jennifer H Gay
(74) *Attorney, Agent, or Firm*—Rodney B. Carroll

(57) ABSTRACT

The present invention is a surface controlled subsurface safety valve (SCSSV) for use in a well, preferably a hydrocarbon producing well. The SCSSV comprises a valve body having a longitudinal bore for fluid to flow through, a bore closure assembly, a pressure balanced drive assembly, and a fail safe assembly. The bore closure assembly is positioned and normally biased to close the bore to fluid flow. The drive assembly is coupled to the bore closure assembly for driving the bore closure assembly to an open position. The fail safe assembly is positioned and configured to hold the bore closure assembly in the open position in response to a hold signal and to release the valve to return to the safe, closed position upon interruption of the hold signal.

48 Claims, 8 Drawing Sheets

ELECTRO MECHANICALLY ACTUATED

HYDRAULICALLY ACTUATED

ALTERNATIVE HYDRAULICALLY ACTUATED

FAIL SAFE SURFACE CONTROLLED SUBSURFACE SAFETY VALVE FOR USE IN A WELL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The present invention is a surface controlled subsurface safety valve (SCSSV) for use in a well, preferably a hydrocarbon producing well. Many hydrocarbon producing wells contain a subsurface safety valve located down hole in the production string to shut off hydrocarbon flow in the event of an emergency. Well production strings continue to increase in depth, particularly for offshore wells, due to increases in both well and water depths. In order to prevent injury to personnel and to protect the environment and equipment, the present invention addresses the need for a subsurface safety valve that closes quickly and reliably when installed at any depth, and especially these increased depths, within a well.

SUMMARY OF THE INVENTION

The present invention is a surface controlled subsurface safety valve (SCSSV) for use in a well, preferably a hydrocarbon producing well. The SCSSV comprises a valve body having a longitudinal bore for fluid to flow through, a bore closure assembly, a pressure balanced drive assembly, and a fail safe assembly. The bore closure assembly is positioned and normally biased to close the bore to fluid flow. The drive assembly is coupled to the bore closure assembly for driving the bore closure assembly to an open position. The fail safe assembly is positioned and configured to hold the bore closure assembly in the open position in response to a hold signal and to release the valve to return to the safe, closed position upon interruption of the hold signal.

DETAILED DESCRIPTION OF THE INVENTION

Figure 1:
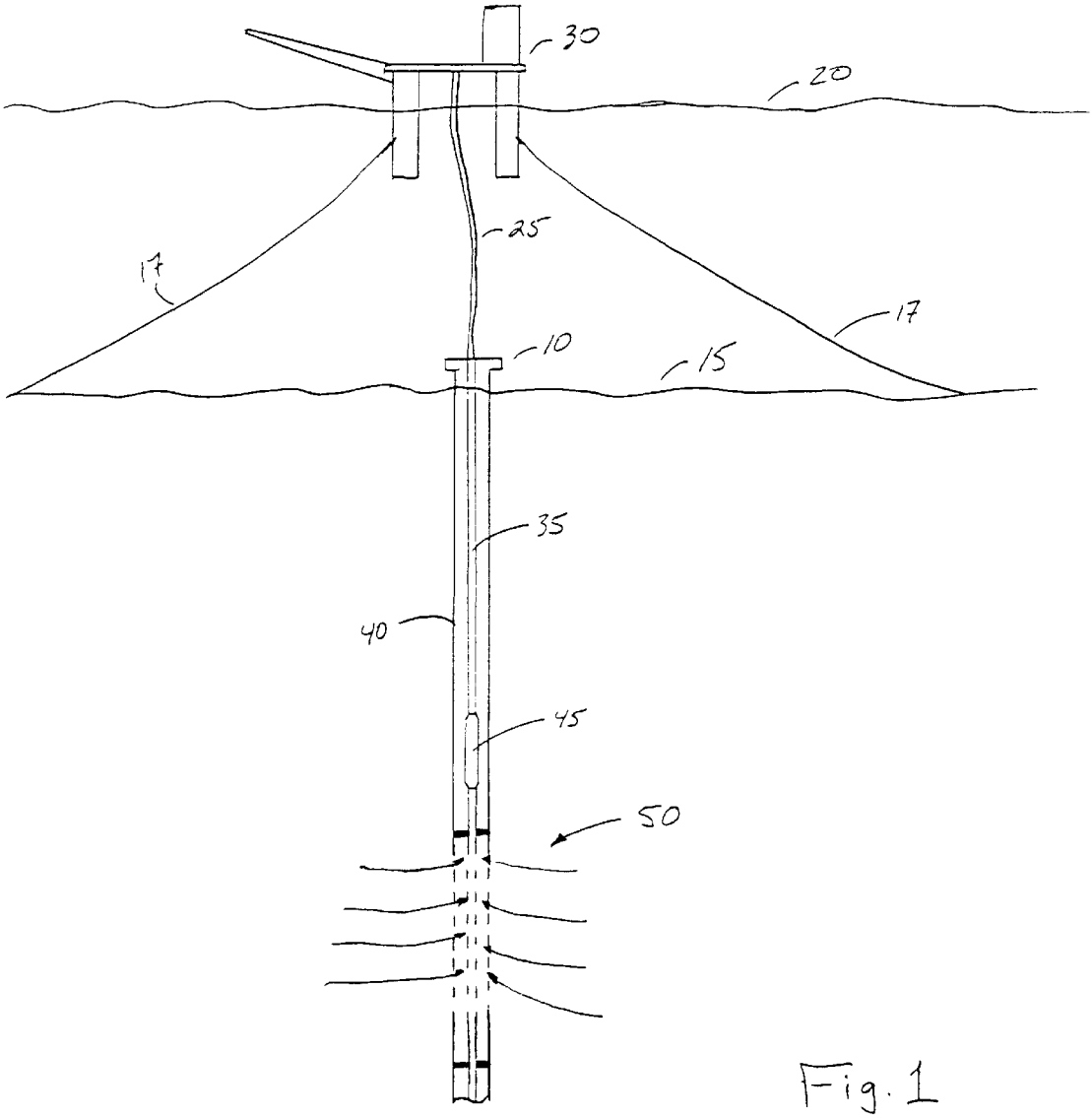
FIG. 1 shows the SCSSV of this invention installed in an off-shore hydrocarbon producing well.
Figure 2:
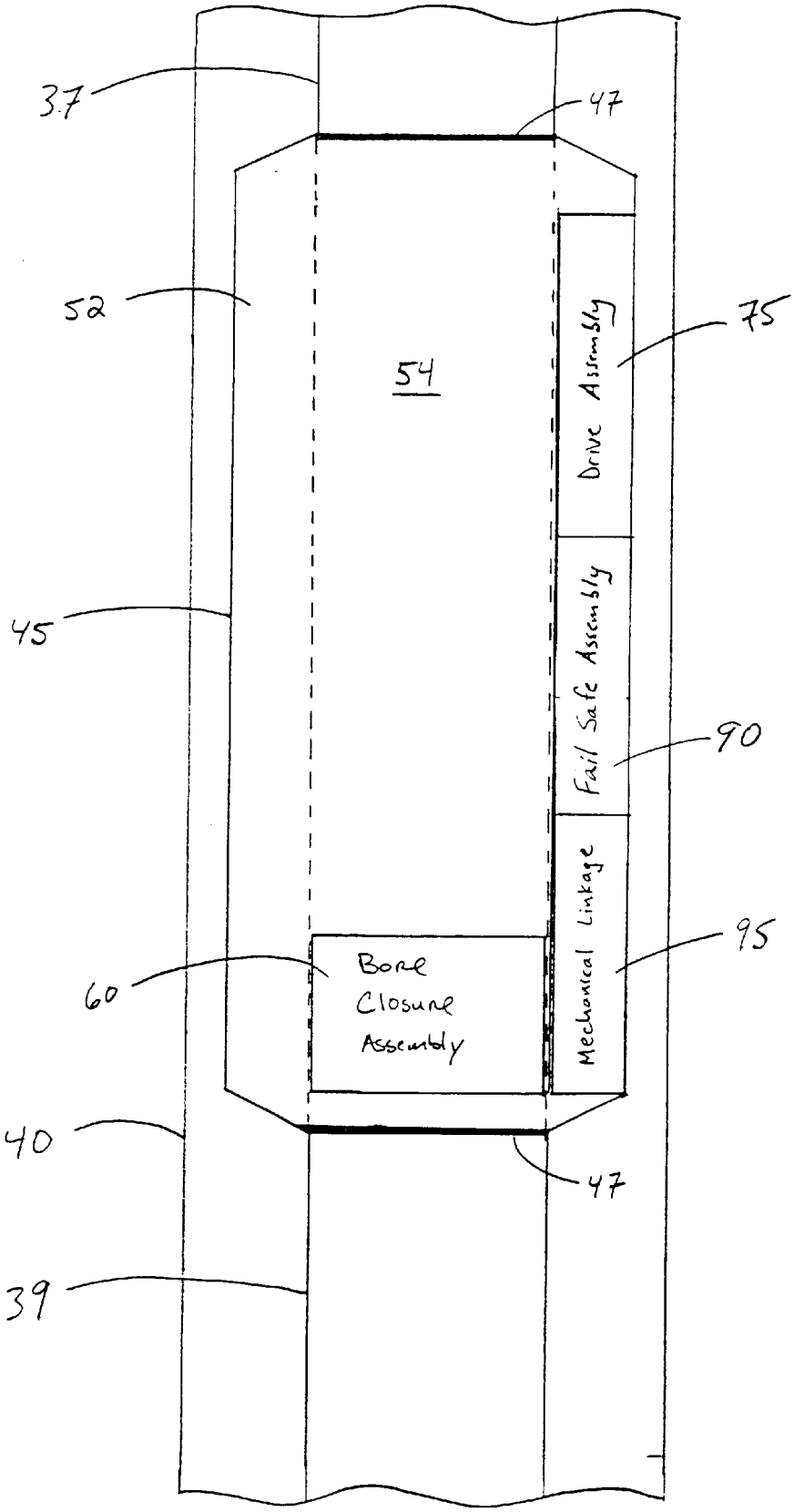
FIG. 2 is a close-up, cross-sectional view showing the major components of the SCSSV of this invention installed in a well.

FIG. 1 shows a surface controlled subsurface safety valve (SCSSV) 45 of the present invention installed in an offshore hydrocarbon producing well. The wellhead 10 rests on the ocean floor 15 and is connected by a flexible riser 25 to a production facility 30 floating on the ocean surface 20 and anchored to the ocean floor by tethers 17. The well production string includes flexible riser 25 and downhole production string 35 (FIG. 1) positioned in the wellbore below the wellhead 10. The SCSSV 45 is mounted in the downhole production string below the wellhead. As shown in FIG. 2, the SCSSV 45 is preferably mounted between upper section 37 and lower section 39 of downhole production string 35 by threaded joints 47. The exact location that the subsurface safety valve is mounted in the downhole production string is dependent upon the particulars of a given well, but in general the SCSSV is mounted upstream from the hydrocarbon gathering zone 50 of the production string, as shown in FIG. 1.

Figure 3:
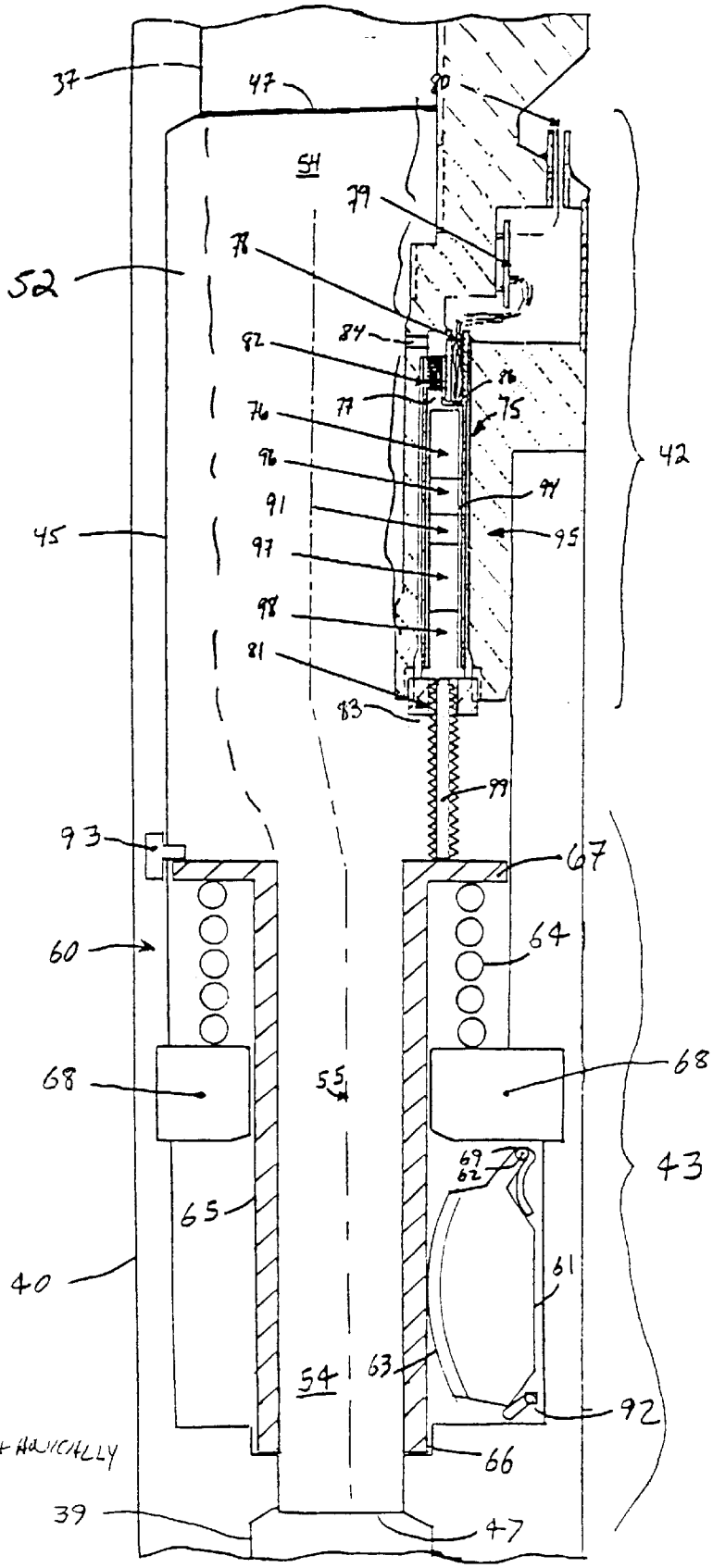
FIG. 3 is a detailed, cross-sectional view of a preferred electro-mechanically actuated embodiment of the SCSSV of this invention installed in a well.

Referring to FIGS. 2 and 3, the SCSSV 45 comprises a valve body 52 having an upper assembly 42, a lower assembly 43, and a longitudinal bore 54 extending the length of the valve body. The longitudinal bore forms a passageway for fluid to flow between the lower section 39 and the upper section 37 of the downhole production string. The SCSSV further comprises a pressure balanced drive assembly 75 coupled to a bore closure assembly 60. As used herein, a pressure balanced drive assembly means a drive configuration in which the driving force need only overcome the resistance force that normally biases the bore closure assembly to a closed position (e.g., the force of spring 64). Preferably, the pressure balanced drive assembly 75 uses a mechanical linkage 95 to drive the bore closure assembly 60 to an open position in response to a control signal. A fail safe assembly 90 is positioned and configured to hold the bore closure assembly in the open position while the control signal is being received and to release the bore closure assembly to return to the safe, closed position upon interruption of the control signal. A unique feature of the pressure balanced drive assembly is that it need not overcome any additional force created by differential pressure or hydrostatic head of control fluid from the surface.

While drive assembly 75, fail safe assembly 90, and mechanical linkage 95 are shown as separate components in FIG. 2, it should be understood that these three assemblies can be integrated into fewer than three components, for example a single drive/fail safe/linkage component or two components such as a drive/fail safe component coupled to a linkage component or a drive component coupled to a fail safe/linkage component. Preferably, drive assembly 75, fail safe assembly 90, and mechanical linkage 95 are housed in the upper assembly 42 of SCSSV 45 and the bore closure assembly 60 is housed in the lower assembly 43 of SCSSV 45.

The bore closure assembly is positioned and normally biased to close the longitudinal bore to fluid flow. In a preferred embodiment shown in FIG. 3, the bore closure assembly 60 is a flapper valve disposed within longitudinal bore 54 near the lower end of SCSSV 45. As its name implies, a flapper valve opens and closes the SCSSV to fluid flow by rotation of a flapper 61 about a hinge 69 on axis 62 transverse to the axis 55 of the longitudinal bore. The conventional means of actuating the flapper is to employ an axially movable flow tube 65 that moves longitudinally within the bore 54, the lower end 66 of the flow tube abutting the flapper 61 and causing the flapper to rotate about its hinge and open the SCSSV to fluid flow upon a downward movement by the flow tube. The flapper valve is normally biased to close the longitudinal bore to fluid flow. Compression spring 64, positioned between the flow tube ring 67 and a flapper seat 68, normally biases the flow tube 65 in the upward direction such that the lower end 66 of the flow tube in the valve closed position does not press downward upon the flapper 61. With the flow tube in a retracted position, the flapper 61 is free to rotate about axis 62 in response to a biasing force exerted by, for example, a torsion spring (not shown) positioned along axis 62 and applying a force to hinge 69. Flapper 61 rotates about axis 62 such that the sealing surface 63 contacts the flapper seat 68, thereby sealing bore 54 to fluid flow.

In an alternative preferred embodiment (not shown), the bore closure assembly is a ball valve disposed within longitudinal bore 54 near the lower end of SCSSV 45. Ball valves employ a rotatable spherical head or ball having a central flow passage which can be aligned with respect to the bore to open the SCSSV to fluid flow. Rotation of the ball valve through an angle of 90 degrees will prevent flow through the central flow passage, thereby closing the SCSSV to fluid flow. The ball valve is normally biased to close the longitudinal bore to fluid flow. An example of a suitable ball valve bore closure assembly is shown in U.S. Pat. No. 4,467,870, incorporated herein by reference in its entirety.

Conventionally, flapper and ball valves are actuated by an increase or decrease in the control fluid pressure in a separate control line extending from the SCSSV to the ocean surface, in the case of an SCSSV installed in an offshore well. As SCSSVs are installed at deeper and deeper depths, the length of the control line increases, resulting in an increase in the pressure of the control fluid at the SCSSV due to the hydrostatic head associated with the column of control fluid in the control line. As a result of the higher pressure, significant problems are encountered with a hydraulic control signal from the surface such as a significant delay in valve closure time and the extreme design criteria for the equipment, both downhole and at the surface. Thus, in the present invention, a pressure balanced (also referred to as a pressure compensated) drive assembly is used to actuate the bore closure assembly in place of a hydraulic control signal from the surface.

Referring to FIGS. 2–5, the pressure balanced drive assembly 75 comprises an actuator coupled by a mechanical linkage 95 to the bore closure assembly 60 for driving the bore closure assembly to open the SCSSV 45 in response to an electronic control signal from the surface. The actuator may be an electric (e.g., electric motor 76 in FIG. 3) or hydraulic (e.g., pump 102 in FIGS. 4 and 5) actuator. In the preferred embodiments shown in FIGS. 3–5, the pressure balanced drive assembly comprises an actuator housed in a sealed chamber 77 filled with an incompressible fluid, for example dielectric liquids such as a perfluorinated liquid. The actuator is surrounded by a clean operating fluid and is separated from direct contact with the wellbore fluid. Preferably, the actuator is connected by connector 78 to a local controller 79 such as a circuit board having a microcontroller and actuator control circuit. The local controller is preferably housed in a separate control chamber that is not filled with fluid and that is separated from the chamber 77 by high pressure seal 86, provided however that the local controller could be housed in the same fluid-filled chamber as the actuator so long as the local controller is designed to survive the operating conditions therein. The local controller is capable of receiving control signals from the surface and sending data signals back to the surface, for example by an electrical wire 80 to the surface or by a wireless communicator (not shown). Alternatively, the controller may be positioned remotely rather than locally, for example at the surface, and may communicate with the SCSSV, for example by electrical wire 80 or by wireless transmission. Where an electrical wire is used, the control signal is preferably a low power control signal that consumes less than about 10 watts in order to minimize the size of the wire required to transmit the signal across the potentially long distances associated with deep-set SCSSVs. Power to the actuator may be supplied by direct electrical connection to the electrical wire 80 or through the wall of the sealed chamber 77 by an inductive source located outside the chamber through use of inductive coupling, which eliminates the need for the connector 78.

The sealed chamber 77 further comprises a means for balancing the pressure of the incompressible fluid with the pressure of the wellbore fluid contained within the longitudinal bore 54. In a preferred embodiment, bellows 81 and 82 are used to balance the pressure of the incompressible fluid in the sealed chamber 77 with the pressure of the wellbore fluid. The bellows 81 is in fluid communication with the chamber fluid and the wellbore fluid as noted by reference numeral 83. Bellows 82 is in fluid communication with the chamber fluid and the wellbore fluid as shown by passage 84. A preferred embodiment wherein bellows 81 is a sealing bellows and bellows 82 is a compensation bellows is disclosed in International Application No. PCT/EPOO/01552, International Filing Date Feb. 25, 2000, International Publication No. WO 00/53890, International Publication Date Sep. 14, 2000, incorporated by reference herein in its entirety.

Figure 3A:
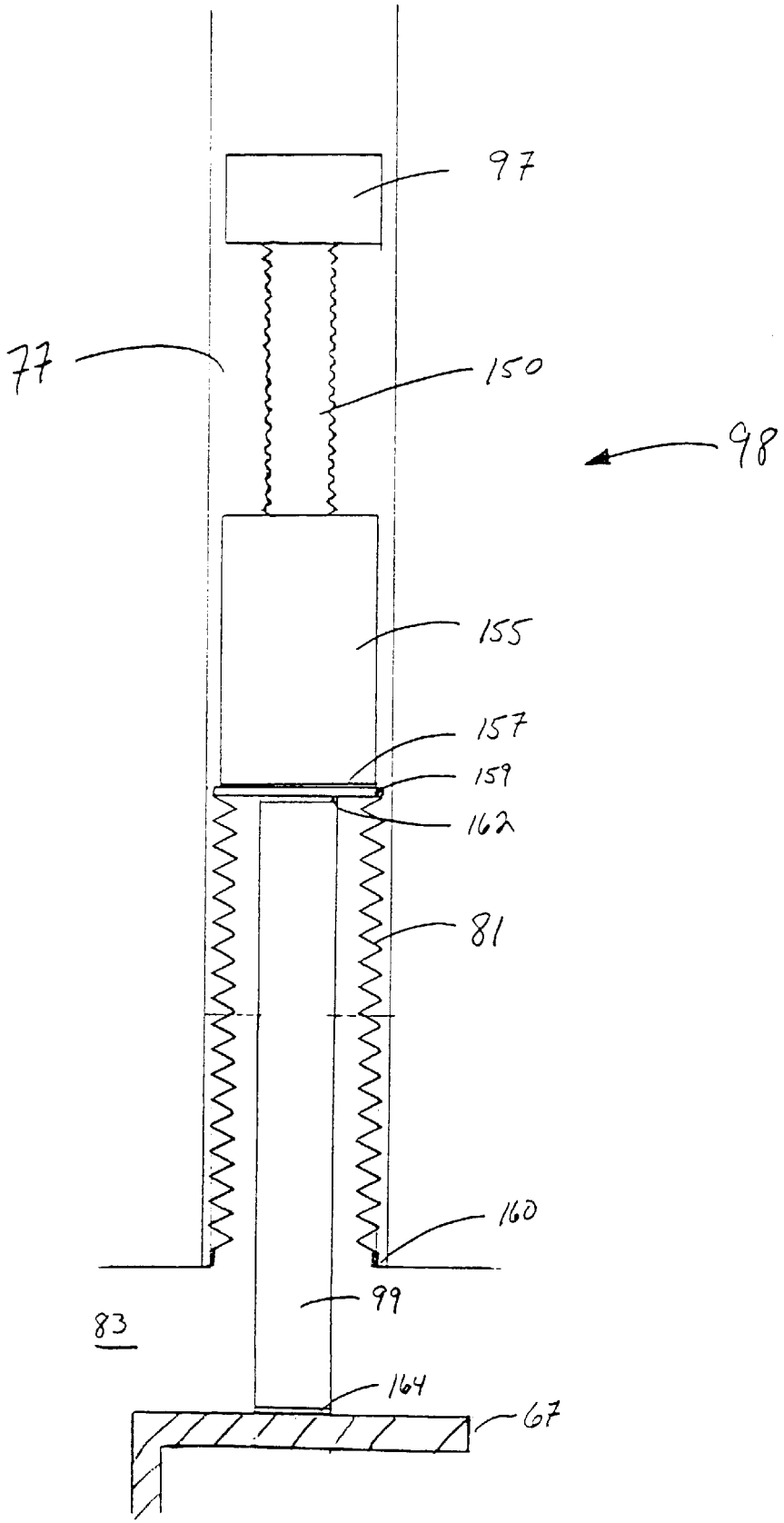
FIG. 3A is a close-up view of a preferred ball screw assembly and bellows arrangement.

Preferably, a mechanical linkage 95 is used by the drive assembly 75 to exert an actuating force on the bore closure assembly 60 to open the SCSSV to fluid flow, provided however a mechanical linkage need not be employed in all embodiments, as shown by the direct electrically actuated embodiment of FIG. 6 described below. The mechanical linkage may be any combination or configuration of components suitable to achieve the desired actuation of the bore closure assembly. In the preferred embodiment of FIG. 3, the mechanical linkage comprises a gear reducer 97 and a ball screw assembly 98, or alternatively a roller screw assembly in place of the ball screw assembly. FIG. 3A shows a preferred ball screw assembly and bellows arrangement. The ball screw assembly further comprises ball screw 150, the upper end of the ball screw is connected to the gear reducer 97 and the lower end of the ball screw is threaded into a drive nut 155. The gear reducer 97 serves to multiply the torque of the electric motor 76 delivered to the ball screw assembly 98, and more than one gear reducer may be employed as needed along the drive line between the motor 76 and the ball screw assembly 98. The lower end 157 of the drive nut 155 contacts the end face 159 of the bellows 81. The bellows 81 is fixedly connected at the edge 160 of the sealed chamber 77, and is arranged to expand or contract upward from edge 160 and into the sealed chamber 77. The lower side of end face 159 of the bellows 81 is in contact with the upper end 162 of power rod 99, which is exposed to the wellbore fluid as noted by reference numeral 83. The lower end 164 of power rod 99 is in contact with, and preferably is fixedly connected to, the flow tube ring 67. In response to rotation of the ball screw 150 by the gear reducer 97, the drive nut 155 is restrained from rotating and thus travels axially as the ball screw 150 rotates, thereby moving the power rod 99 and the flow tube ring 67 downward to open the SCSSV to fluid flow. Alternatively, the drive nut 155 can be rotated while the ball screw 150 is held from rotating, but allowed to travel axially to actuate the flow tube.

Alternatively, as shown in FIG. 3, the bellows 81 may be arranged to expand or contract downward from the edge 160 rather than upward into the sealed chamber 77 in response to movement by the power rod 99, which is exposed to the incompressible fluid in the sealed chamber 77. In this alternative embodiment, the upper end 162 of the power rod 99 is in contact with, and preferably is fixedly connected to, the lower end 157 of the drive nut 155. The lower end 164 of power rod 99 is in contact with the upper side of end face 159 of bellows 81, which is in contact with the flow tube ring 67.

Figure 4:
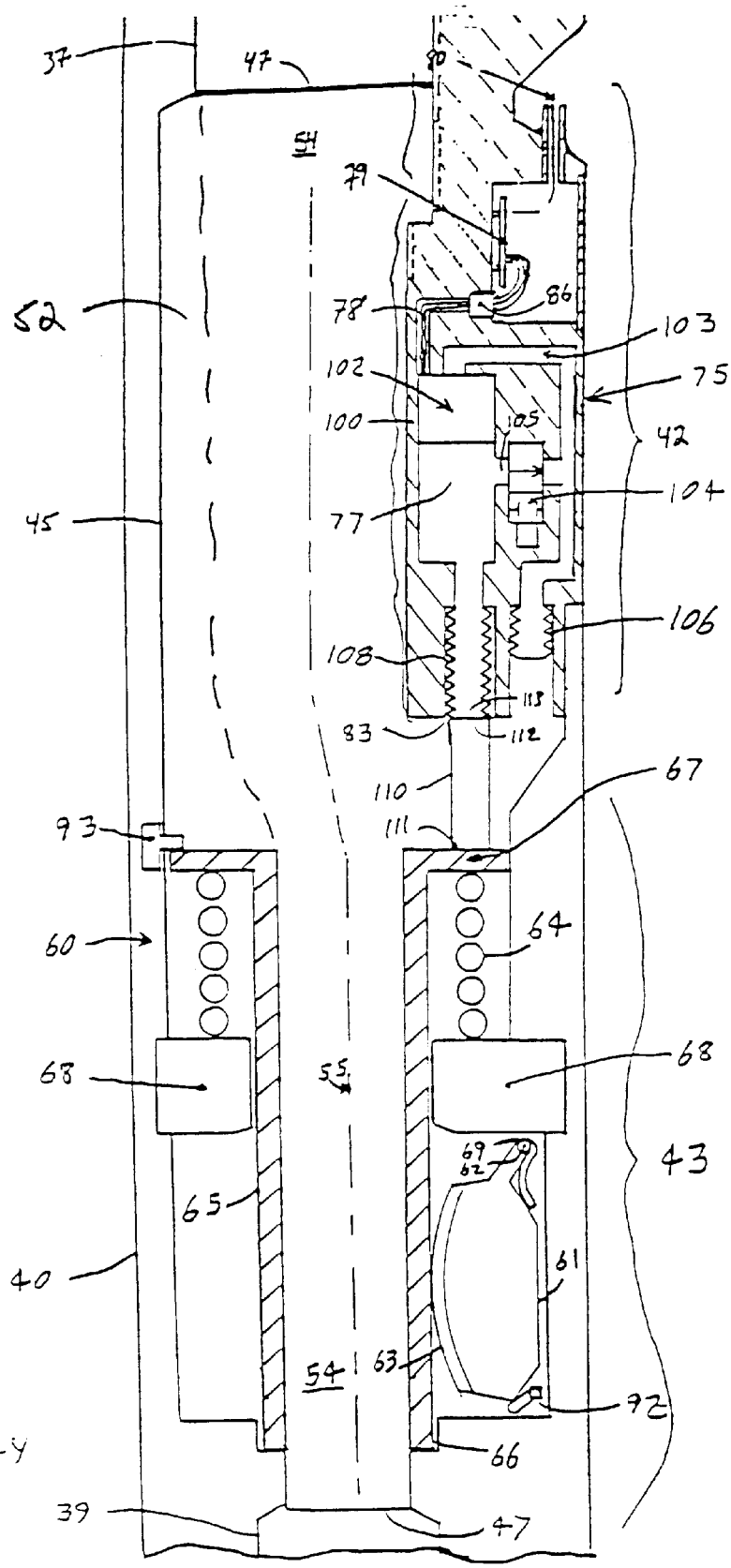
FIG. 4 is a detailed, cross-sectional view of the upper assembly of a preferred hydraulically actuated embodiment of the SCSSV of this invention.
Figure 5:
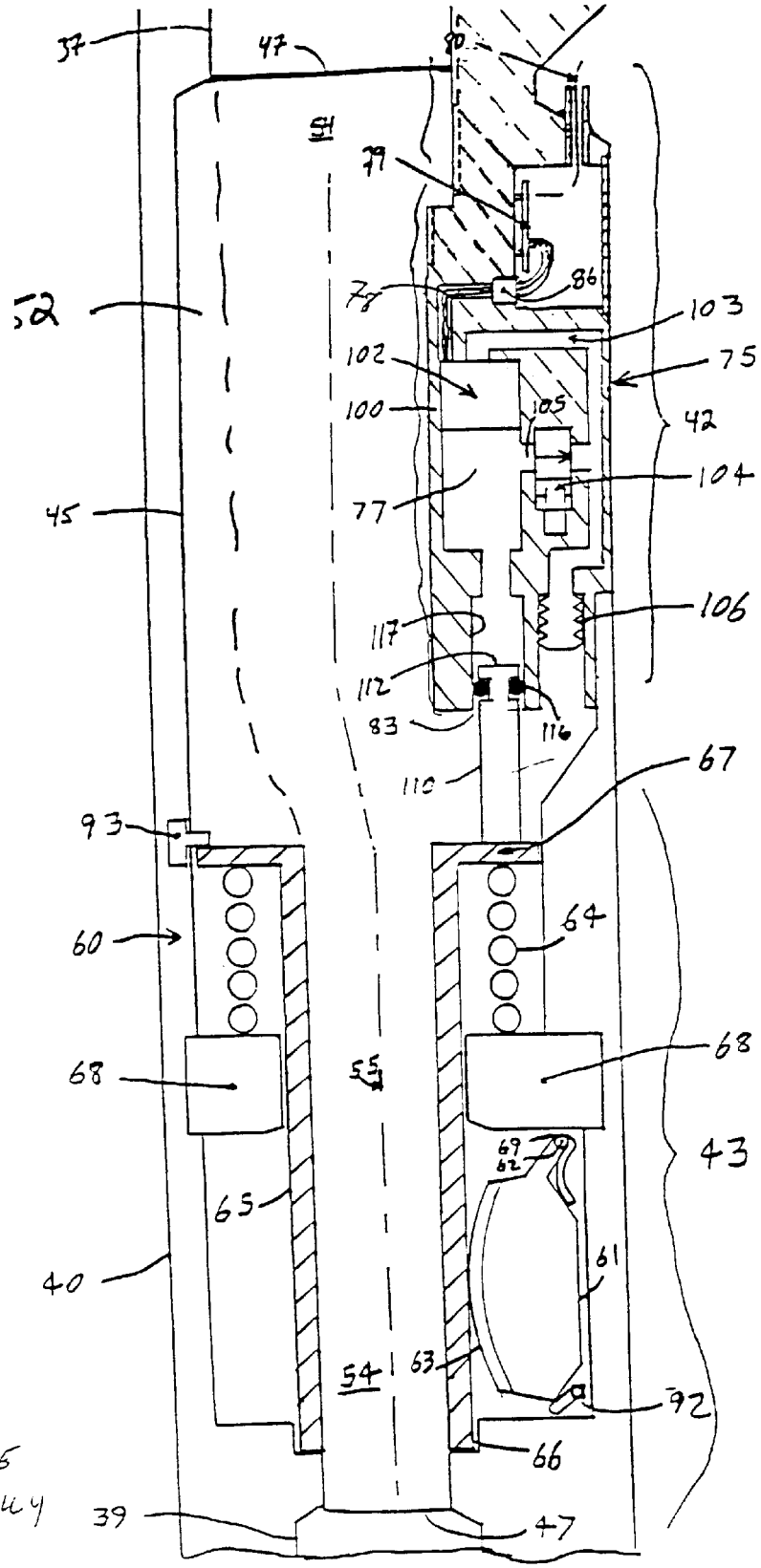
FIG. 5 is a detailed, cross-sectional view of an alternative hydraulically actuated embodiment of the SCSSV of this invention.

In the hydraulically actuated embodiments shown in FIGS. 4 and 5, the pressure balanced drive assembly 75 comprises a hydraulic actuator 100 further comprising a pump 102 and a control valve 104 housed within the sealed chamber 77 filled with an incompressible fluid. The sealed chamber 77 further comprises a hydraulic loop 103, with a suction side of the loop in fluid communication with a bellows 106, a discharge side of the loop in fluid communication with a bellows 108, and a fluid jumper line 105 containing the control valve 104 connecting the discharge side of the loop with the suction side of the loop. The control valve preferably is a normally open electric control valve that is powered closed and controlled by a control circuit, preferably the local controller 79 as described previously for the electromechanical actuated embodiment of FIG. 3. The control valve blocks the hydraulic pressure within the hydraulic loop and may be any type of valve suitable for the particular incompressible fluid, such as a solenoid valve, a spring-biased check valve, or a flow switch (used with an MR fluid, as described below).

Preferably, the pump 102 is an electric pump that is powered and controlled by a control circuit, preferably the local controller 79 as described previously. As an alternative to a direct electrical connection, the electric pump can be powered by inductive coupling. The suction side of the pump 102 is connected to the reservoir side of the hydraulic loop. To open the SCSSV, the control valve 104 is powered closed and the pump is activated. The incompressible fluid from the reservoir formed by the bellows 106 is pumped into the discharge side of the hydraulic loop. As fluid fills the discharge side, hydraulic pressure is exerted on the bellows 108, thereby expanding the bellows 108 and forcing a shaft 110, and likewise the flow tube 65, downward and opening the flapper 61. The shaft 110 serves as the mechanical linkage 95 and is exposed to the wellbore fluid as noted by reference numeral 83. The lower end 111 of shaft 110 is in contact with, and preferably is fixedly connected to, the flow tube ring 67 on the flow tube 65. The upper end 112 of the shaft 110 is in contact with the end face 113 of the bellows 108. As discussed previously, the bellows 106 and 108 are in fluid communication with the wellbore fluid, and thus further comprise the means for balancing the pressure of the incompressible fluid with the pressure of the wellbore fluid contained within longitudinal bore 54.

Once the SCSSV is fully opened, the fail safe assembly is set (as discussed below), the pump is deactivated, and the signal which closed the control valve 104 is removed (thus allowing the control valve to open). Opening the control valve equalizes the hydraulic pressure on the discharge side of the hydraulic loop, which, upon the occurrence of a fail safe event, allows the bellows 108 and the shaft 110 to retract and flow tube 65 to move upward, closing the flapper 61. Equalizing the hydraulic pressure by opening the control valve 104 also preserves the bellows 108 by minimizing the amount of time that the bellows 108 is exposed to a pressure differential between the incompressible fluid and the wellbore fluid. Alternatively, the hydraulic pressure can be maintained on the discharge side of the hydraulic loop, and the electronically controlled control valve 104 can serve as the fail safe assembly by remaining closed in response to a hold signal (thereby holding the bore closure assembly in the open position) and by opening and releasing the hydraulic pressure upon interruption of the hold signal (thereby allowing the shaft 110 to retract and the bore closure assembly to close). Where hydraulic pressure is maintained on the discharge side of the hydraulic loop, the local controller preferably monitors a means for sensing and communicating the position of the bore closure assembly (as described in more detail below) and activates the pump in the event that the bore closure assembly begins to creep shut, for example due to a loss of hydraulic pressure across the pump seals.

In an alternative embodiment, one or more sealed pistons are used in place of one or more of the bellows in FIGS. 3 and 4. In a preferred alternative embodiment shown in FIG. 5, the shaft 110, which serves as the mechanical linkage to stroke flow tube ring 67, contains one or more seals 116 that replace the bellows 108. As fluid fills the discharge side of the hydraulic loop, hydraulic pressure is exerted on the upper end 112 of the shaft 110 (sealed by the seal 116 against the inside wall 117 of chamber 77), thereby forcing the shaft 110, and likewise the flow tube 65, downward and opening the flapper 61 as discussed previously. Preferably, once the fail safe assembly is set as described below, hydraulic pressure extending the piston is bled-off across the control valve 104, thereby preserving the piston seals. Alternatively, the hydraulic pressure can be maintained on the discharge side of the hydraulic loop and the position of the bore closure assembly monitored as described previously.

Figure 6:
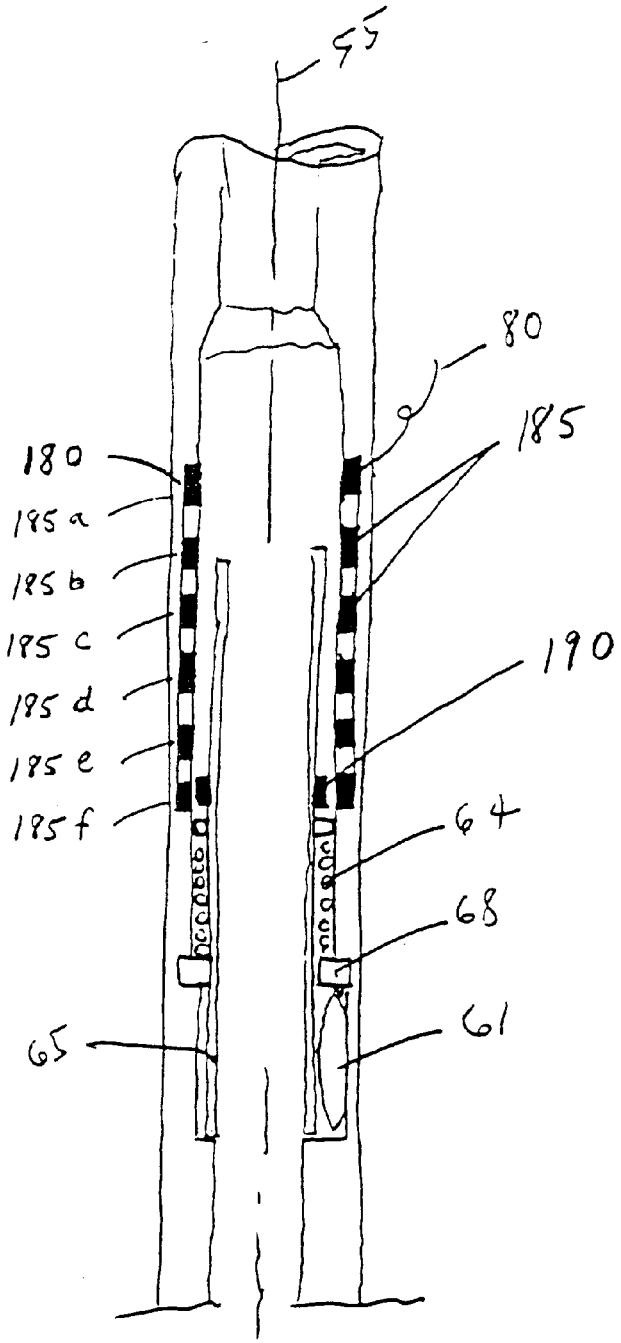
FIG. 6 is a detailed, cross-sectional view of a direct electrically actuated embodiment of the SCSSV of this invention.

In an alternative, direct electrically actuated embodiment shown in FIG. 6, the pressure balanced drive assembly comprises a linear induction motor 180. The linear induction motor 180 may be housed within a sealed chamber, or alternatively may be in contact with the wellbore fluid, provided that it is designed to withstand such contact. Preferably, the linear induction motor 180 comprises a plurality of stator coils 185*a*–185*f* arranged concentric with and longitudinally along the axis 55 of the bore. A movable armature 190 is integral with or connected (via a suitable mechanical linkage as discussed above) to the bore closure assembly. Preferably, the movable armature 190 is integral with the flow tube 65. A magnetic field created by progressively stepping an electrical current through the stator coils 185 (using a controller as described previously) drives the armature in a longitudinal direction parallel to the axis 55 of the bore, which in turn actuates the bore closure assembly (e.g., the flapper 61 or a ball valve) to open the SCSSV as described previously. The bore closure assembly is held in the open position by the fail safe assembly as described below.

Referring to FIG. 2, the fail safe assembly 90 is positioned and configured to hold the bore closure assembly 60 in the open position (commonly referred to as the "fully open" position) while the control signal is being received and to release the bore closure assembly to return to the safe, closed position upon interruption of the control signal. The fail safe assembly serves as a means for holding the bore closure assembly open in response to a control signal. The fail safe assembly 90 holds the valve in the open position in response to receipt of a control signal to do so, also referred to as a "hold" signal. Preferably, the hold signal is communicated through a wire or by wireless communication from a control center located at the surface. In the event that the hold signal is interrupted resulting in the fail safe assembly no longer receiving the hold signal (i.e., upon the occurrence of a fail safe event), the fail safe assembly releases and allows the valve to automatically return to the safe, closed position. In other words, the SCSSV according to this invention is a fail-safe valve. The hold signal might be interrupted, for example, unintentionally by a catastrophic failure along the riser, wellhead, or production facility, or intentionally by a production operator seeking to shut-in the well in response to particular operating conditions or needs such as maintenance, testing, or production scheduling. In effect, the pressure balanced drive assembly is what "cocks" or "arms" the SCSSV by driving the SCSSV from its normally biased closed position into an open position, the fail safe assembly serves as the "trigger" by holding the SCSSV in the open position during normal operating conditions in response to a hold signal, and interruption or failure of the hold signal is what causes the SCSSV to automatically "fire" closed.

In the preferred embodiment of FIG. 3, the fail safe assembly comprises an anti-backdrive device 96 and an electromagnetic clutch 91. The fail safe assembly is preferably configured such that electromagnetic clutch 91 is positioned between the anti-backdrive device 96 (which is connected to motor 76) and the gear reducer 97 (which is connected to the ball screw assembly 98), provided however that the individual components of the fail safe assembly may be placed in any operable arrangement. For example, the electromagnetic clutch 91 may be positioned between the gear reducer 97 and the ball screw assembly 98. Alternatively, the electromagnetic clutch 91 may be interposed between gear reducer sets. When engaged, the electromagnetic clutch 91 serves as a couple for the motor 76 to drive the ball screw assembly 98. Conversely, when the electromagnetic clutch 91 is disengaged, the motor 76 is mechanically isolated from the ball screw assembly 98. The local controller 79 engages the electromagnetic clutch 91 by applying an electrical current to the clutch and disengages the clutch by removing the electrical current to the clutch.

In response to a control signal to open the SCSSV, the electric motor 76 is powered and the electromagnetic clutch 91 is engaged to drive the ball screw assembly 98, thereby forcing the flow tube 65 downward against the flapper 61 and opening the SCSSV 45 to fluid flow. The electric motor drives the bore closure assembly to a predetermined (i.e., fully) open position, as sensed and communicated to the drive assembly (i.e., electric motor) by a means for sensing and communicating the position of the bore closure assembly. An example of a suitable means for sensing and communicating the position of the bore closure assembly is a feedback loop sensing the position of the bore closure assembly (for example, the location of the flow tube 65, flapper 61, ball nut of the ball screw assembly 98, or ball valve (not shown)) and communicating the position to the drive assembly, preferably via the local controller. Alternative means for sensing and communicating the position of the bore closure assembly include an electrical current monitor on the drive assembly, wherein a spike in current indicates that the drive assembly has driven the bore closure assembly to a limit (i.e., to the open position) or a driving cycle counter on the drive assembly, wherein the number of driving cycles (i.e., revolutions, strokes, etc.) is calibrated to the position of the bore closure assembly.

The fail safe assembly holds the bore closure assembly in the open position in response to a hold signal. In FIG. 3, the anti-backdrive device prevents the ball screw assembly from reversing. A preferred anti-backdrive device conveys a rotational force in only one direction, for example a sprag clutch. In response to rotation by the electric motor 76, the sprag clutch freewheels and remains disengaged. Conversely, in response to a reversal or back-drive force transmitted by the spring 64 through the ball screw assembly 98, cogs in the sprag clutch engage, thereby preventing counter rotation and locking the bore closure assembly in the open position. Alternative anti-backdrive devices include (but are not limited to) a non-backdriveable gear reducer, an electromagnetic brake, a spring-set brake, a permanent magnet brake on the electric motor 76, a means for holding power on the electric motor 76 (i.e., "locking the rotor" of the electric motor), a locking member (as described below), a piezoelectric device (as described below), or a magnetorheological (MR) device (as described below).

The anti-backdrive device holds the bore closure assembly in the open position so long as electromagnetic clutch 91 remains engaged. Thus, the hold signal for the embodiment shown in FIG. 3 is the electric current powering and thereby engaging the electromagnetic clutch 91. As described previously, the hold signal can be interrupted either intentionally (for example, by a person signaling the local controller to close the valve) or unintentionally (for example, due to a failure of power or communications to the SCSSV). Upon interruption of the hold signal, the electromagnetic clutch 91 disengages, allowing the ball screw assembly to reverse, the flow tube 65 to move upward in response to the biasing force of the spring 64, and the flapper 61 to rotate closed about the axis 62. The electromagnetic clutch 91 isolates the electric motor 76 from reversal or backdrive forces transmitted across the mechanical linkage, thereby preventing damage to electric motor 76 and facilitating quick closure of the SCSSV (preferably, closure in less than about 5 seconds).

Figure 7:
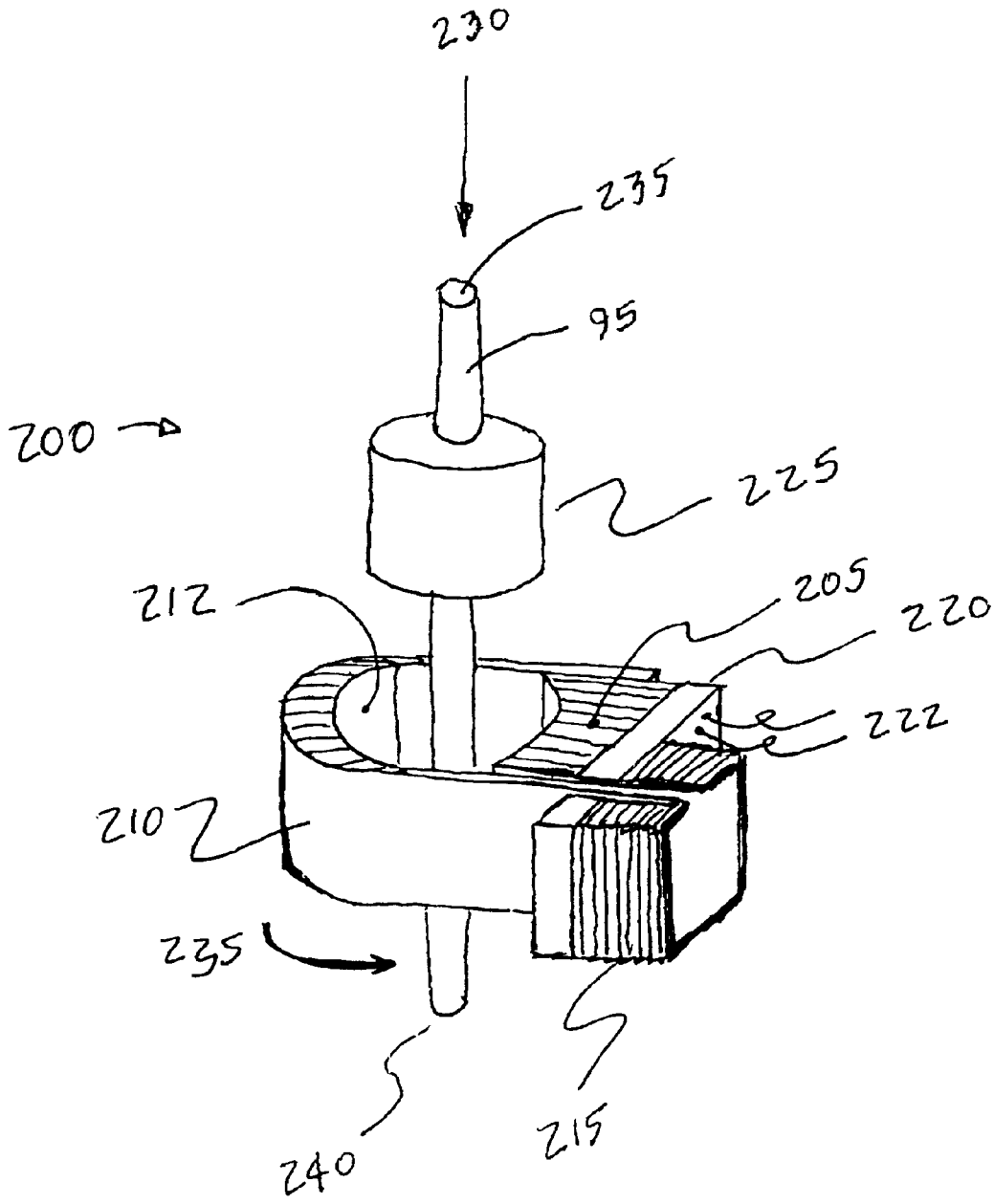
FIG. 7 is a detailed view of a piezoelectric device used in a fail safe assembly.

In an alternative embodiment shown in FIG. 7, the fail safe assembly comprises a piezoelectric device 200 having a stator 205, a flexible band 210, a piezoelectric stack 215, and an electrical connector pad 220. The piezoelectric device is positioned such that a moving member of the drive assembly 75, fail safe assembly 90, mechanical linkage 95, or bore closure assembly 60 is surrounded in a close tolerance relationship by the band 210. In the preferred embodiment shown in FIG. 7, the band 210 is connected at one end to the stator 205 and at the other end to the piezoelectric stack 215. Alternatively, piezoelectric stacks could be positioned at both ends of the band 210. In the preferred embodiment, the band 210 is designed to surround a collar 225 on the mechanical linkage 95, thus providing a close tolerance relationship upon the mechanical linkage moving downward (as shown by arrow 230) as the bore closure assembly is driven to the open position, as described previously. The upper end 230 of the mechanical linkage 95 is connected to the drive assembly 75 and the lower end 240 of the mechanical linkage 95 is connected to the bore closure assembly 60. Alternatively, the piezoelectric device 200 could be placed to surround, upon the bore closure assembly being driven to the open position, the drive nut 155 in FIG. 3A or to surround the shaft 110 in FIGS. 4 and 5 or a collar on the shaft 110 (not shown). While the preferred embodiment of FIG. 7 shows the movable member (i.e., the collar 225) moving in the longitudinal direction upon actuation of the bore closure assembly, it should be understood that the piezoelectric device 200 is also applicable to a movable member that rotates about an axis rather than moving longitudinally. For example, the piezoelectric device 200 could be placed around and in a close tolerance relationship with the gear reducer 97 in FIG. 3A.

Upon application of an electrical signal via wires 222 to the connector pad 220, the piezoelectric stack deforms, thereby tightening the band 210 (as shown by arrow 235) around the moving member (i.e., the collar 225) and locking the moving member into place against the stator 205. The piezoelectric stack is preferably a stack of piezoceramic material sized to provide adequate deformation and thus adequate holding force (via the tightening of the band 210 around the collar 225) to overcome backdrive forces. An alternative deformable member can be used in place of a piezoelectric stack, for example electrostrictive stacks actuated by application of an electrical field or magnetostrictive actuators actuated by application of a magnetic field, typically produced by running an electric current through an electromagnet. The band 210 and/or the stator 205 may be lined with a suitable friction-producing material or mechanical engagement device such as teeth, as shown by reference numeral 212. Additionally, the braking force produced by the stack may be amplified by levers. The piezoelectric device preferably is electronically controlled such that the piezoelectric device remains engaged in response to a hold signal and releases upon interruption of the hold signal as described previously. A piezoelectric device may be used as the fail safe assembly on any of the embodiments shown in the figures.

The piezoelectric device may be used in the hydraulically actuated embodiments of FIGS. 4 and 5, and in a preferred embodiment in cooperation with the shaft 110 as described previously. The piezoelectric device may be used with the direct electrically actuated embodiment of FIG. 6, for example by placing the piezoelectric device around and in a close tolerance relationship with the movable armature 190 or other appropriate movable member of the bore closure assembly.

In the electro-mechanically actuated embodiment of FIG. 3, the piezoelectric device preferably is used in combination with the electromagnetic clutch 91, wherein the piezoelectric devices serves as the anti-backdrive device and the clutch serves to isolate the electric motor 76 from reversal or backdrive forces, thereby preventing damage to the electric motor 76 and facilitating quick closure of the SCSSV. Where the piezoelectric device is located between the electric motor and the electromagnetic clutch, a hold signal to the electromagnetic clutch serves as the primary "trigger" for firing the SCSSV closed upon the occurrence of a fail safe event (provided however that the piezoelectric device and the electromagnetic clutch typically would release simultaneously, especially in the event of a catastrophic failure resulting in a loss of power to the SCSSV). Where the electromagnetic clutch is located between the electric motor and the piezoelectric device, a hold signal to the electromagnetic clutch may serve as the primary "trigger" for firing the SCSSV closed upon the occurrence of a fail safe event, or alternatively a hold signal to the piezoelectric device may serve as the primary "trigger" and the electromagnetic clutch can be disengaged beforehand (or simultaneously with the piezoelectric device).

In an alternative embodiment, the fail safe assembly comprises a locking member such as a latch, a cam, a pin, or a wrap spring that, when engaged, holds the bore closure assembly in the open position. The locking member preferably is electronically controlled such that the locking member remains engaged in response to a hold signal and releases upon interruption of the hold signal as described previously. The locking member may be positioned to hold the flapper 61 open, for example the latch 92 in FIG. 3, or to hold the flow tube in an extended position, for example the retractable pin 93 in FIG. 3. It should be understood that multiple fail safe assemblies are shown on FIG. 3 for convenience, and that while multiple fail safe assemblies can be employed on a SCSSV (for example, for backup purposes), typically only a single fail safe assembly will be used. Furthermore, a locking member may be used as the fail safe assembly on any of the embodiments shown in the figures, provided however that if a locking member is used in the electro-mechanically actuated embodiment of FIG. 3, the locking member is preferably combined with the electromagnetic clutch 91 as described previously for the piezoelectric device 200.

In an alternative embodiment, the fail safe assembly is a magneto-rheological (MR) device comprising an MR fluid and a means for applying a magnetic field to the MR fluid. The MR fluid is an incompressible fluid filled with ferromagnetic particles that bind together magnetically when a magnetic field is applied, resulting is a dramatic increase in the viscosity of the fluid. An example of a suitable MR fluid is Rheonetic brand MR fluid available from Lord Corporation of Cary, N.C. Alternatively, an electro-rheological (ER) fluid activated by an electrical field and a means for applying an electrical field can be used in place of an MR fluid and a means for applying a magnetic field. The MR device is positioned such that a moving member of the drive assembly 75, fail safe assembly 90, mechanical linkage 95, or bore closure assembly 60 is locked into place upon application of the magnetic field to the MR fluid. The MR device preferably is electronically controlled such that the MR device remains engaged in response to a hold signal and releases upon interruption of the hold signal as described previously. An MR device may be used as the fail safe assembly on any of the embodiments shown in the figures.

In a preferred embodiment, the fail safe assembly comprises an MR device used as the anti-backdrive device in FIG. 3, wherein the MR fluid is used as the incompressible fluid contained within the sealed chamber 77. Preferably, the MR device is combined with the electromagnetic clutch 91 as described previously for the piezoelectric device 200. As shown by reference numeral 94 in FIG. 3, the walls of the chamber 77 form a close-tolerance annular gap with at least one movable member of a component housed within the chamber. For example, gear reducer 97 and the walls of the chamber 77 form a close-tolerance annular gap filled by the MR fluid. In the absence of a magnetic field, the MR fluid flows freely within the annular gap in response to movement by the moveable member (e.g., the gear reducer 97). Upon application of a magnetic field to the MR fluid to engage the MR device, the MR fluid becomes very viscous and forms a bridge that occludes the annular gap, thus "freezing" into place at least one movable member of a component housed within the chamber (e.g., the gear reducer 97). Any suitable means for applying a localized magnetic field may be employed, such as an electromagnetic coil located adjacent to the chamber 77. The MR device preferably is electronically controlled such that the MR device remains engaged in response to a hold signal and releases upon interruption of the hold signal as described previously.

In an alternative embodiment, the fail safe assembly comprises an MR fluid used as the incompressible hydraulic fluid in the chamber 77 in FIGS. 4 and 5. The control valve 104 is a flow switch capable of producing a magnetic field such that the jumper line 105 is occluded from fluid flow upon application of the magnetic field, thereby maintaining the hydraulic pressure in the discharge side of the hydraulic loop and holding the bore closure assembly in the open position. The flow switch preferably is electronically controlled such that the flow switch remains engaged in response to a hold signal and releases upon interruption of the hold signal, thereby reducing the hydraulic pressure in the discharge side of the hydraulic loop and allowing the shaft 110 to retract and the flow tube 65 to move upward as described previously.

What is claimed is:

1. A fail-safe, surface controlled subsurface safety valve for use in a well, comprising:

a valve body having a longitudinal bore for fluid to flow through, a bore closure assembly, a pressure balanced drive assembly, and a fail safe assembly:

the bore closure assembly being positioned and normally biased to close the bore to fluid flow;

the pressure balanced drive assembly coupled to the bore closure assembly for driving the bore closure assembly to an open position wherein the pressure balanced drive assembly further comprises a sealed chamber filled with an incompressible fluid and the pressure of the incompressible fluid is balanced with the wellbore pressure by at least one bellows connected to the sealed chamber; and the fail safe assembly being positioned and configured to hold the bore closure assembly in the open position in response to a hold signal and to release the valve to return to the safe, closed position upon interruption of the hold signal.

2. The valve of claim 1 wherein the pressure balanced drive assembly further comprises an electric motor coupled to the bore closure assembly by a mechanical linkage.

3. The valve of claim 2 wherein the mechanical linkage further comprises a gear reducer coupled to a screw assembly selected from the group consisting of a ball screw assembly and a roller screw assembly.

4. The valve of claim 3 wherein the electric motor and at least a portion of the ball screw assembly are housed within the sealed chamber.

5. The valve of claim 3 wherein the fail safe assembly further comprises an electromagnetic clutch and a sprag clutch, wherein the electric motor is connected to the sprag clutch, which is connected to the electromagnetic clutch, which is connected to the gear reducer, which is connected to the ball screw assembly.

6. The valve of claim 3 wherein the fail safe assembly further comprises an electromagnetic clutch and a sprag clutch, wherein the electric motor is connected to the sprag clutch, which is connected to a first gear reducer, which is connected to thc electromagnetic clutch, which is connected to a second gear reducer, which is connected to the ball screw assembly.

7. The valve of claim 2 wherein power is supplied to the electric motor by inductive coupling.

8. The valve of claim 2 wherein the electric motor and at least a portion of the mechanical linkage are housed within the sealed chamber.

9. The valve of claim 2 wherein the fail safe assembly selected from the group consisting of a piezoelectric device, an electrostrictive device, and a magnetostrictive device is operable upon the mechanical linkage such that upon engagement, a movable member of the mechanical linkage is locked into place.

10. The valve of claim 2 wherein the fail safe assembly selected from the group consisting of a magnetorheological device and an electrorheological device is operable upon the mechanical linkage such that upon engagement, a movable member of the mechanical linkage is locked into place.

11. The valve of claim 2 wherein the incompressible fluid is selected from the group consisting of a magnetorheological fluid and an electrorheological fluid, and the fail safe assembly further comprising a field generating means selected respectively from the group consisting of a means for applying a magnetic field to the magnetorheological fluid or a means for applying an electrical field to the electrorheological fluid, the field generating means being configured such that upon application of the respective field a moving member of the mechanical linkage is locked into place.

12. The valve of claim 1 wherein the fail safe assembly further comprises an electromagnetic clutch and an anti-backdrive device connected to and positioned between the pressure balanced drive assembly and the bore closure assembly.

13. The valve of claim 12 wherein the anti-backdrive device is selected from the group consisting of a sprag clutch, a non-backdriveable gear reducer, an electromagnetic brake, a spring-set brake, a permanent magnet brake on the electric motor, a means for holding power on the electric motor, a locking member, a piezoelectric device, and a magnetorheological (MR) device.

14. The valve of claim 13 wherein the anti-backdrive device is a locking member selected from the group consisting of a latch, a cam, a pin, and a wrap spring.

15. The valve of claim 1 wherein the fail safe assembly further comprises a locking member selected from the group consisting of a latch, a cam, a pin, and a wrap spring.

16. The valve of claim 1 wherein the fail safe assembly is selected from the group consisting of a piezoelectric device, an electrostrictive device, and a magnetostrictive device.

17. The valve of claim 1 wherein the fail safe assembly is selected from the group consisting of a magnetorheological device and an electrorheological device.

18. The valve of claim 1 wherein the bore closure assembly further comprises a flapper valve, the flapper valve being held in the open position by a flow tube.

19. The valve of claim 18 further comprising a feedback loop sensing the position of the flow tube and communicating the position to the drive assembly.

20. The valve of claim 1 wherein the bore closure assembly further comprises a ball valve.

21. The valve of claim 20 further comprising a feedback loop sensing the position the ball valve and communicating the position to the drive assembly.

22. The valve of claim 1 further comprising a means for sensing the position of the bore closure assembly and communicating the position to the drive assembly.

23. The valve of claim 22 wherein the sensing means is an electrical current monitor monitoring the drive assembly, wherein a spike in current indicates that the drive assembly has driven the bore closure assembly to a limit.

24. The valve of claim 22 wherein the sensing means is driving cycle counter monitoring the drive assembly, wherein the number of driving cycles is calibrated to the position of the bore closure assembly.

25. The valve of claim 1 wherein the hold signal consumes less than about 10 watts.

26. The valve of claim 25 wherein the hold signal is transmitted through a wire.

27. The valve of claim 25, wherein the hold signal is a wireless transmission.

28. The valve of claim 1 wherein the valve closes in less than about 5 seconds upon interruption of the hold signal.

29. The valve of claim 1 wherein the valve is insensitive to the depth at which it is installed in the well.

30. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail safe assembly being positioned and configured to hold the bore closure assembly in the open position in response to a hold signal and to release the valve to return to the safe, closed position upon interruption of the hold signal; and wherein the pressure balanced drive assembly comprises a hydraulic actuator coupled to the bore closure assembly by a mechanical linkage and is configured such that the driving force need only overcome the resistance force that normally biases the bore closure assembly to the closed position.

31. The valve of claim 30 wherein the mechanical linkage further comprises a shaft.

32. The valve of claim 31 wherein the hydraulic actuator further comprises an electric pump for pumping the incompressible fluid in a hydraulic loop and applying a driving force to the shaft and a control valve for regulating the pressure in the hydraulic loop.

33. The valve of claim 32 wherein the control valve is selected from the group consisting of a solenoid valve, a spring-biased check valve, and a flow switch.

34. The valve of claim 33 wherein the incompressible fluid is selected from the group consisting of a magnetorheological fluid and an electrorheological fluid and wherein the flow switch respectively applies a magnetic field to the magnetorheological fluid or an electrical field to the electrorheological fluid such that upon application of the respective filed a moving member of the shaft is locked into place.

35. The valve of claim 32 wherein power is supplied to the electric pump by inductive coupling.

36. The valve of claim 32, wherein the hydraulic actuator and at least a portion of the shaft are housed within a sealed chamber filled with an incompressible fluid and the pressure of the incompressible fluid is balanced with the wellbore pressure by at least one piston connected to the sealed chamber.

37. The valve of claim 32 wherein the hydraulic actuator is housed within a sealed chamber filled with an incompressible fluid and the shaft is not housed within the scaled chamber, and the pressure of the incompressible fluid is balanced with the wellbore pressure by at least one piston connected to the sealed chamber.

38. The valve of claim 30 wherein the hydraulic actuator and at least a portion of the mechanical linkage are housed within a sealed chamber filled with an incompressible fluid and the pressure of the incompressible fluid is balanced with thc wellbore pressure by at least one piston connected to the sealed chamber.

39. The valve of claim 8 wherein the fail safe assembly further comprises a locking member selected from the group consisting of a latch, a cam, a pin, and a wrap spring.

40. The valve of claim 30 wherein the fail safe assembly selected from the group consisting of a magnetorheological device and an electrorheological device is operable upon the mechanical linkage such that upon engagement, a movable member of the mechanical linkage is locked into place.

41. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail sate assembly being positioned and configured to hold the bore closure assembly in the open position in response to a hold signal and to release the valve to return to the safe, closed position upon interruption of the hold signal;

wherein the pressure balanced drive assembly comprises a hydraulic actuator coupled to the bore closure assembly by a mechanical linkage and wherein the hydraulic actuator and at least a portion of the mechanical linkage are housed within a sealed chamber filled with an incompressible fluid and the pressure of the incompressible fluid is balanced with the wellbore pressure by at least one bellows connected to the scaled chamber.

42. The valve of claim 41 wherein the incompressible fluid is selected from the group consisting of a magnetorheological fluid and an electrorheological fluid, and the fail safe assembly further comprising a field generating means selected respectively from the group consisting of a means for applying a magnetic field to the magnetorheological fluid or a means for applying an electrical field to the electrorheological fluid, the field generating means being configured such that upon application of the respective field a moving member of the mechanical linkage is locked into place.

43. A fail-sale, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail safe assembly being positioned and configured to hold the bore closure assembly in the open position in response to a hold signal and to release the valve to return to the safe, closed position upon interruption of the hold signal;

wherein the pressure balanced drive assembly comprises a hydraulic actuator coupled to the bore closure assembly by a mechanical linkage;

wherein the mechanical linkage further comprises a shaft;

wherein the hydraulic actuator further comprises an electric pump for pumping the incompressible fluid in a hydraulic loop and applying a driving force to the shaft and a control valve for regulating the pressure in the hydraulic loop; and wherein the hydraulic actuator and an least a portion of the shall are housed within a scaled chamber filled with an incompressible fluid and the pressure of the incompressible fluid is balanced with the wellbore pressure by at least one bellows connected to the sealed chamber.

44. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly the driving the bore closure assembly to an open position;

the fail safe assembly being positioned and configured to hold the bore closure assembly in the open position in response to a hold signal and to release the valve to return to the safe, closed position upon interruption of the hold signal;

wherein the pressure balanced drive assembly comprises a hydraulic actuator coupled to the bore closure assembly by a mechanical linkage;

wherein the mechanical linkage further comprises a shaft;

wherein the hydraulic actuator further comprises an electric pump for pumping the incompressible fluid in a hydraulic loop and applying a driving force to the shaft and a control valve for regulating the pressure in the hydraulic loop; and wherein the hydraulic actuator is housed within a sealed chamber filled with an incompressible fluid and the shaft is not housed within the sealed chamber, and the pressure of the incompressible fluid is balanced with the wellbore pressure by at least one bellows connected to the sealed chamber.

45. The valve of claim 44, wherein the incompressible fluid is selected from the group consisting of a magnetorheological fluid and an electrorheological fluid, and the fail safe assembly further comprising a field generating means selected respectively from the group consisting of a means for applying a magnetic field to the magnetorheological fluid or a means for applying an electrical field to the electrorheological fluid, the field generating means being configured such that upon application of the respective field a moving member of the mechanical linkage is locked into place.

46. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail safe assembly being positioned and configured to hold the bore closure assembly in the open position in response to a hold signal and to release the valve to return to the safe, closed position upon interruption of the hold signal;

wherein the pressure balanced drive assembly further comprises an electric motor coupled to the bore closure assembly by a mechanical linkage;

wherein the fail safe assembly selected from the group consisting of a piezoelectric device, an electrostrictive device, and a magnetorestrictive device is operable upon the mechanical linkage such that upon engagement, a movable member of the mechanical linkage is locked into place; and wherein the fail safe assembly selected from the group consisting of a piezoelectric device, an electrostrictive device, and a magnetostrictive device further comprises a band surrounding the movable member and at least one end of the band connected to a deformable member selected respectively from the group consisting of a piezoelectric stack, an electrostrictive stack, and a magnetostrictive actuator, the deformable member having an electrical connection, the fail safe assembly being configured such that upon application of an electrical signal to the electrical connection, the deformable member deforms, thereby tightening the band around the movable member and locking the movable member into place against a stator.

47. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail safe assembly being positioned and configured to hold the bore closure assembly in the open position in response to a hold signal and to release the valve to return to the safe, closed position upon interruption of the hold signal;

wherein the pressure balanced drive assembly comprises a hydraulic actuator coupled to the bore closure assembly by a mechanical linkage; and wherein the fail safe assembly selected from the group consisting of a piezoelectric device, an electrostrictive device, and a magnetostrictive device further comprises a band surrounding the movable member and at least one end of the band connected to a deformable member selected respectively from the group consisting of a piezoelectric stack, an electrostrictive stack, and a magnetostrictive actuator, the deformable member having an electrical connection, the fail safe assembly being configured such that upon application of an electrical signal to the electrical connection, the deformable member deforms, thereby tightening the band around the movable member and locking the movable member into place against a stator.

48. A fail-safe, surface controlled subsurface safety valve for use in a well, comprising:

a valve body having a longitudinal bore for fluid to flow through, a bore closure assembly, a pressure balanced drive assembly, and a fail safe assembly;

the bore closure assembly being positioned and normally biased to close the bore to fluid flow;

the pressure balanced drive assembly coupled to the bore closure assembly for driving the bore closure assembly to an open position;

the fail safe assembly being positioned and configured to hold the bore closure assembly in the open position in response to a hold signal and to release the valve to return to the safe, closed position upon interruption of the hold signal;

wherein the pressure balanced drive assembly further comprises a linear induction motor generating a magnetic field that actuates the bore closure assembly; and wherein the fail safe assembly selected from the group consisting of a piezoelectric device, an electrostrictive device, and a magnetostrictive device further comprises a band surrounding the movable member and at least one end of the band connected to a deformable member selected respectively from the group consisting of a piezoelectric stack, an electrostrictive stack, and a magnetostrictive actuator, the deformable member having an electrical connection, the fail safe assembly being configured such that upon application of an electrical signal to the electrical connection, the deformable member deforms, thereby tightening the band around the movable member and locking the movable member into place against a stator.

* * * * *